US007624817B2

(12) United States Patent
Putnam

(10) Patent No.: US 7,624,817 B2
(45) Date of Patent: Dec. 1, 2009

(54) BORE HOLE REAMING APPARATUS AND METHOD

(76) Inventor: Samuel W. Putnam, 305 Darbonne Dr., West Monroe, LA (US) 71291

( * ) Notice: Subject to any disclaimer, the term of this patent is extended or adjusted under 35 U.S.C. 154(b) by 165 days.

(21) Appl. No.: 11/879,345

(22) Filed: Jul. 17, 2007

(65) Prior Publication Data

US 2008/0023226 A1 Jan. 31, 2008

Related U.S. Application Data

(60) Provisional application No. 60/833,360, filed on Jul. 27, 2006.

(51) Int. Cl.
*E21B 7/30* (2006.01)
*F16L 55/18* (2006.01)
*F16L 55/165* (2006.01)

(52) U.S. Cl. ..... 175/53; 405/156; 405/174; 405/184; 405/184.3

(58) Field of Classification Search ..... 405/156, 405/184.3, 174, 184; 175/53, 19
See application file for complete search history.

(56) References Cited

U.S. PATENT DOCUMENTS

| | | | | |
|---|---|---|---|---|
| 1,855,046 | A | 4/1932 | Gerhardt | |
| 2,511,017 | A | 8/1950 | Nestle | |
| 3,310,113 | A | 3/1967 | Maness | |
| 3,541,628 | A | 11/1970 | Girard | |
| 3,827,492 | A | 8/1974 | Hammon et al. | 166/173 |
| 4,384,624 | A * | 5/1983 | Duke et al. | 175/19 |
| 5,306,101 | A | 4/1994 | Rockower et al. | 405/154 |
| 5,375,669 | A | 12/1994 | Cherrington | 175/53 |
| RE35,271 | E * | 6/1996 | Fisk et al. | 405/184.3 |
| 5,580,188 | A | 12/1996 | Nowak | 405/184 |
| 5,628,585 | A | 5/1997 | Parish, II et al. | 405/154 |
| 5,669,199 | A | 9/1997 | Ludwig et al. | 52/704 |
| 5,785,458 | A * | 7/1998 | Handford | 405/184 |
| 6,357,967 | B1 | 3/2002 | Putnam | 405/184.3 |
| 6,401,813 | B1 | 6/2002 | Carmichael et al. | 166/173 |
| 6,499,912 | B2 | 12/2002 | Coon | 405/184.3 |
| 6,613,154 | B1 | 9/2003 | Lester | 134/8 |
| 6,672,802 | B2 | 1/2004 | Putnam | 405/184 |
| 6,745,839 | B1 | 6/2004 | Simpson | 166/311 |
| 6,896,077 | B1 | 5/2005 | Gunsaulis et al. | 175/62 |
| 2008/0296066 | A1 * | 12/2008 | Putnam | 175/53 |

* cited by examiner

*Primary Examiner*—Giovanna C Wright
(74) *Attorney, Agent, or Firm*—John M. Harrison

(57) ABSTRACT

A bore hole reaming apparatus characterized by one or more cleaning devices such as bursting heads attached to a pull rod and typically having one or more mandrels attached thereto in tandem for pulling a length of pipe through a pre-bored opening using a pulling apparatus. In a typical embodiment the bore hole reaming apparatus is characterized by a pair of bursting heads mounted in spaced-apart relationship in tandem on the pull rod and fitted with one or more mandrels attached to a third bursting head. The mandrel(s) is typically secured to a fourth bursting head by a cable and the fourth bursting head is attached to a string of typically HDPE pipe to be pulled through the bore hole. The mandrel(s) straighten irregularities and clean, smooth and enlarge the bore hole to facilitate pulling the pipe string through the bore hole with minimum friction on the pipe.

14 Claims, 5 Drawing Sheets

BORE HOLE REAMING APPARATUS AND METHOD

CROSS-REFERENCE TO RELATED APPLICATIONS

This application claims the benefit of and incorporates by reference prior filed U.S. Provisional Application Ser. No. 60/833,360, Filed Jul. 27, 2006.

BACKGROUND OF THE INVENTION

Summary of the Invention

This invention relates to trenchless technology for placing pipe such as welded lengths of high density polyethylene (HDPE) pipe in a bored path and more particularly, to a bore hole reaming apparatus for enlarging, clearing, smoothing and cleaning a pre-bored hole in a selected length of terrain between an entry pit and an exit pit. In a typical embodiment the bore hole reaming apparatus is characterized by at least one cleaning, scraping and/or pipe bursting head attached to one end of a pull rod which extends through the undersized pre-bored hole or opening drilled on grade and on line from an entry pit to a pulling apparatus connected to the opposite end of the pull rod in an exit pit. Under circumstances where all or part of the undersized bore hole is irregular and requires straightening to pull the pipe therethrough with minimum friction, one or more mandrels can be attached to pull rod stems or adaptors connected at the pipe cleaning or bursting head or heads and a length or string of pipe to be secured in the bore hole can be attached to the mandrel or to yet another bursting head attached to the mandrel, typically using a cable. The entire tandem bursting head/mandrel/pipe train is articulated to facilitate traversing the undersized bore hole path and the mandrel or mandrels are designed to straighten irregular runs of the bore hole which would normally engage the pipe and cause excessive strain or friction on the pipe, thereby causing the welded, typically plastic pipe string to fail in a conventional pipe-pulling operation. Under circumstances where the bore hole or any portion or run extending between the entry pit and the exit pit is irregular and thus constitutes a hazard to pulling of the pipe directly therethrough, a typical bore hole reaming apparatus includes a lead bursting head attached to the pull rod lying adjacent to the bore hole opening in the entry pit using a pull rod stem or adaptor which is typically threaded at both ends. The pull rod adaptor extends linearly through the lead bursting head and a trailing middle bursting head is secured to the opposite end of the first pull rod adaptor using a second pull rod adaptor. A third bursting head is typically mounted on a third pull rod adaptor attached to the second pull rod adaptor and is also connected to one or more mandrels. The mandrel or mandrel train is, in turn, connected to a rear bursting head, typically by means of a cable, and a length or string of pipe is connected to the rear bursting head, such that the entire tandem train articulates as it is sequentially pulled through the bore at the entry pit by a pulling apparatus located in an exit pit spaced-apart from the entry pit. The articulated reaming apparatus and pipe train is "made up" and the individual components added to the train in sequence as the previously attached component enters the entry pit, until the entire train is complete and pulled into the entry pit bore opening. The pulling apparatus is then operated to advance the pull rod and the bore hole reaming apparatus through the bore, thus enlarging, clearing, drying and smoothing the bore and facilitating a more smooth and straight path for laying the pipe in an environment of minimum friction. While substantially any pulling apparatus which is capable of generating at least about 200,000 pounds of pulling power can be located in the exit pit and coupled to the bore hole reaming apparatus, in another preferred embodiment of the invention the pulling apparatus detailed in my U.S. Pat. No. 7,025,536 is used as a component of the bore hole reaming apparatus of this invention for the task.

BRIEF DESCRIPTION OF THE DRAWINGS

The invention will be better understood by reference to the accompanying drawings, wherein.

DESCRIPTION OF THE PREFERRED EMBODIMENTS

Figure 1:
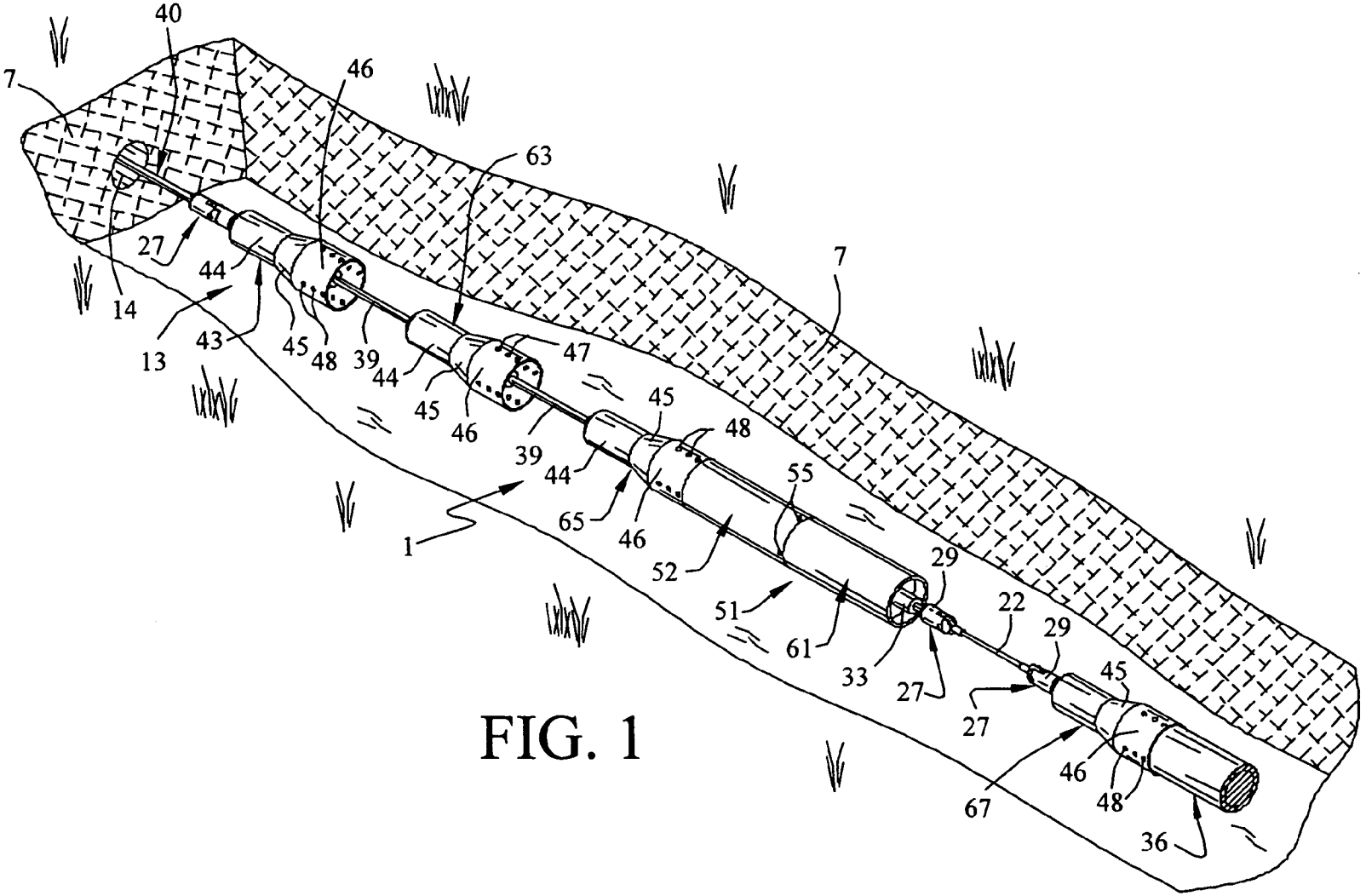
FIG. 1 is a perspective view of a typical bore hole reaming apparatus of this invention in tandem, which includes four cleaning or bursting heads, a pair of reamers and a length or string of pipe to be pulled through a previously bored, undersized opening.
Figure 2:
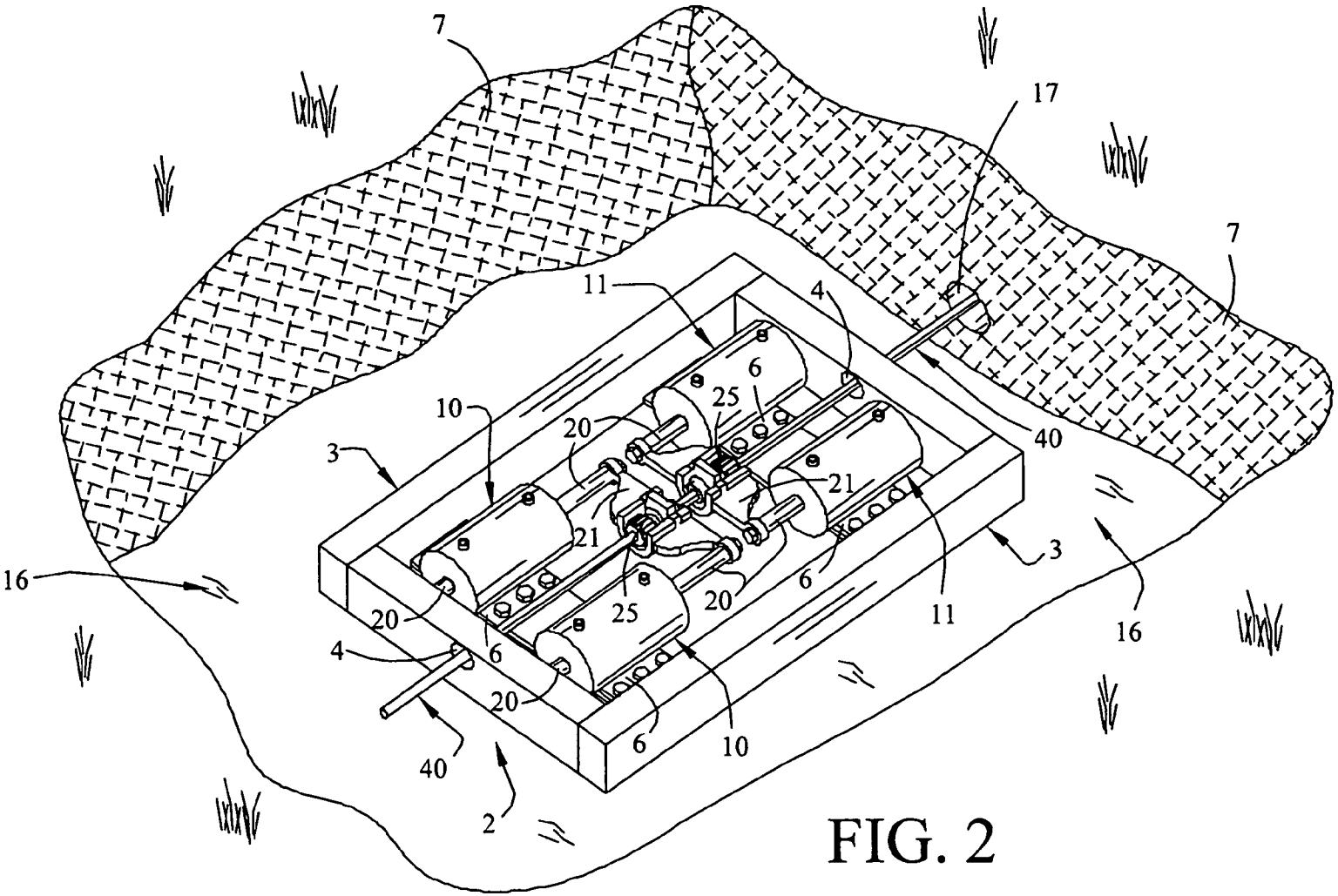
FIG. 2 is a perspective view of a typical pulling apparatus located in an exit pit spaced-apart from the entry pit which receives the bore hole reaming apparatus, for advancing a pull rod through the bore hole along with the bore hole reaming apparatus.

Referring initially to FIGS. 1 and 2 of the drawings, in a preferred embodiment of the invention the bore hole reaming apparatus of this invention is generally illustrated by reference numeral 1. The bore hole reaming apparatus 1 is typically oriented in an entry pit 13 with the respective elements of the apparatus aligned in articulated, tandem relationship as illustrated in FIG. 1. The lead bursting head 43 is connected to one end of a pull rod 40, which extends through the entry pit bore 14 to an exit pit 16, spaced a selected distance from the entry pit 13 and including a pulling apparatus 2 (FIG. 2). The pulling apparatus 2 receives the opposite end of the pull rod 40 and is designed to advance the pull rod 40 through the entry pit bore 14 and into the exit pit bore 17, to pull the bore hole reaming apparatus 1 and a string of pipe 36 from the entry pit 13 to the exit pit 16.

The pulling apparatus 2 can be of any desired design, but is typically characterized by a frame 3, having pull rod openings 4 in opposite ends for receiving the pull rod 40 and fitted with a pair of rear rod driving members 10 and front rod driving members 11 (typically hydraulic cylinders), each having a piston rod 20, respectively, positioned in paired, facing relationship. A rod yoke 21 connects each of the respective pairs of piston rods 20 and a gripping element 25 is provided on each of the rod yokes 21, which gripping elements 25 are aligned to receive and alternately grip the pull rod 40, as further illustrated in FIG. 2. The rear driving rod members 10 and front rod driving members 11 are typically mounted on corresponding mount plates 6, fixed to the frame 3 and the frame 3 is so situated in the exit pit 16 that hydraulic operation of the rear rod driving members 10 and front rod driving members 11, and the gripping elements 25 in sequence, as hereinafter described, advances the pull rod 40 through the exit pit bore 17 and the exit pit 16 with significant pulling force. In a second preferred embodiment of the invention the pulling apparatus 2 illustrated in FIG. 2 is included as an element in the bore hole reaming apparatus 1 of this invention.

Figure 3:
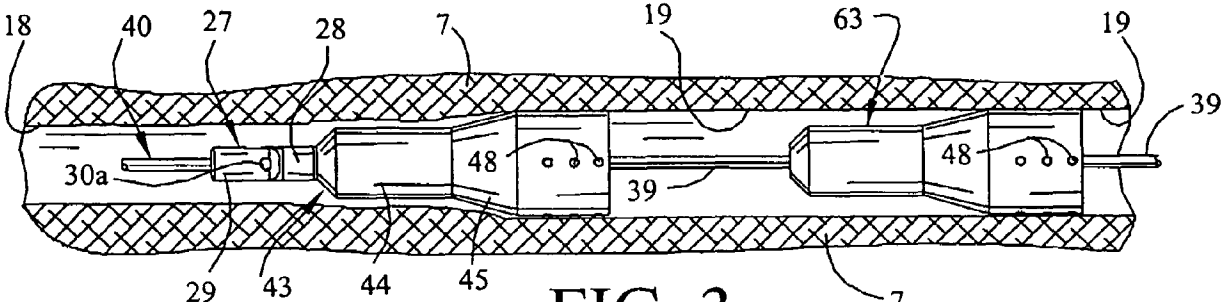
FIG. 3 is a side sectional view of the first pair of cleaning or pipe bursting heads illustrated in tandem in FIG. 1 and connected to the pull rod, more particularly illustrating a preferred technique for mounting the pull rod to the lead pipe bursting head and the pipe bursting heads to each other.
Figure 4:
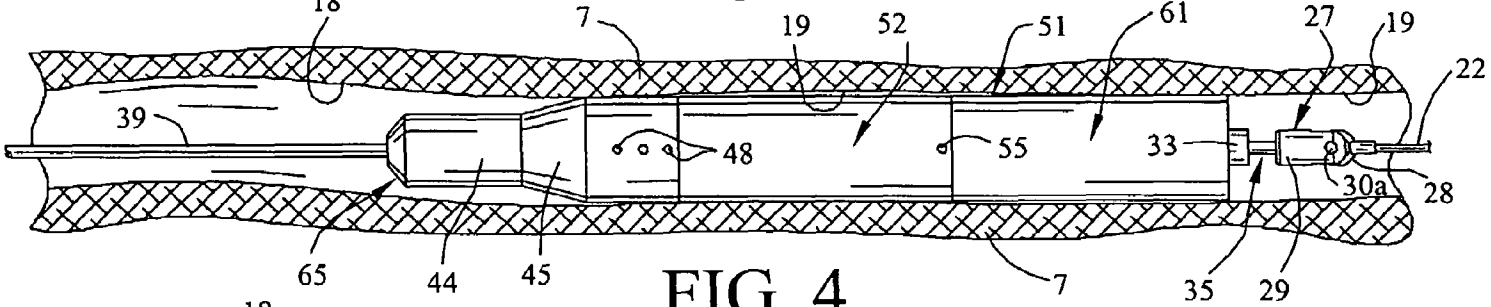
FIG. 4 is a side sectional view of a third cleaning or bursting head in the tandem apparatus illustrated in FIG. 1, attached to a mandrel assembly consisting of a pair of connected mandrels, for straightening out irregularities in the bore hole responsive to pulling of the bore hole reaming apparatus through the bore hole by the pulling apparatus.
Figure 5:
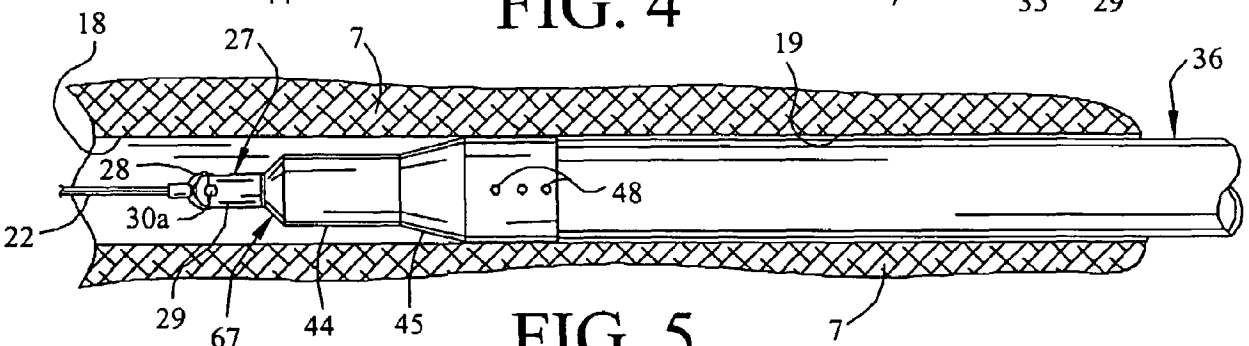
FIG. 5 is a side sectional view of the rear cleaning or bursting head in the tandem apparatus illustrated in FIG. 1, carrying a length of typically welded HDPE pipe and connected to the second mandrel in the mandrel assembly illustrated in FIG. 5, by means of a cable.
Figure 6:
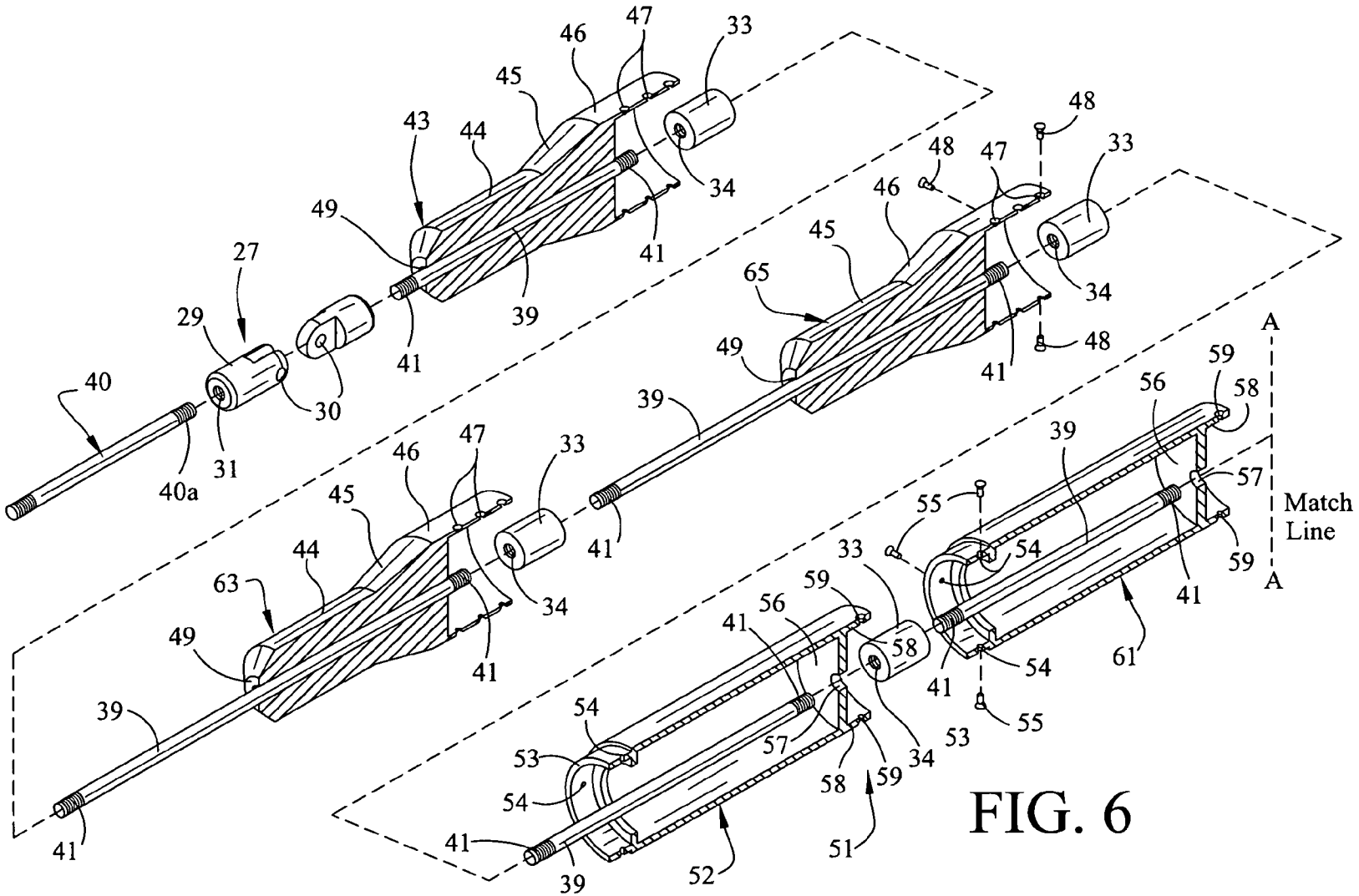
FIGS. 6 and 7 are exploded views of the bore hole reaming apparatus illustrated in FIG. 1, more particularly illustrating preferred techniques for coupling the pull rod and the respective pull rod adaptors and cable to the pipe bursting head, mandrel and pipe string.

Referring to FIGS. 1 and 3-7 of the drawings, the opposite end of the pull rod 40 from the pulling end extends through the entry pit bore 14 of the entry pit 13 as described above and is typically connected to one end of a lead end-threaded pull rod adaptor 39, extending through the lead bursting head 43, by means of a clevis coupling 27 (FIG. 6). The lead bursting head 43 is seated on the lead pull rod adaptor 39, which extends to the clevis coupling 27, while the opposite end of the lead pull rod adaptor 39 extends to a middle bursting head 63, disposed in the entry pit 13 in spaced-apart, tandem relationship with respect to the lead bursting head 43. One end of a second pull rod adaptor 39 is secured to the first or lead pull rod adaptor 39 at the middle bursting head 63 by a rod coupling 33, having rod coupling threads 34. The opposite or rear end of the second pull rod adaptor 39 is attached by means of another rod coupling 33 to a third pull rod adaptor 39, which extends through a spaced-apart third bursting head 65, secured to a first mandrel 52 in a mandrel assembly 51. A second mandrel 61 is attached to the first mandrel 52 and a rod coupling 33 secures the third pull rod adaptor 39 to one end of a fourth pull rod adaptor 39 at the front end of the first mandrel 52 (FIG. 6). Another rod coupling 33 connects the fourth pull rod adaptor 39 to a fifth pull rod adaptor 39 at the rear end of the second mandrel 61 (FIG. 4). One end of a cable 22, having a cable loop 23 on one end (FIG. 7), is secured to a clevis coupling 27 attached to the fifth pull rod adaptor 39 and the opposite or rear end of the cable 22, which is fitted with a second cable loop 23, is attached to another clevis coupling 27 attached to a sixth and last pull rod adaptor 39, extending through a rear bursting head 67; pins 30*a* are typically used in these connections. A length of pipe 36 is attached to the rear bursting head 67, connected to the cable 22, for sequentially pulling through the entry pit bore 14 in the entry pit 13 (FIG. 1).

Figure 7:
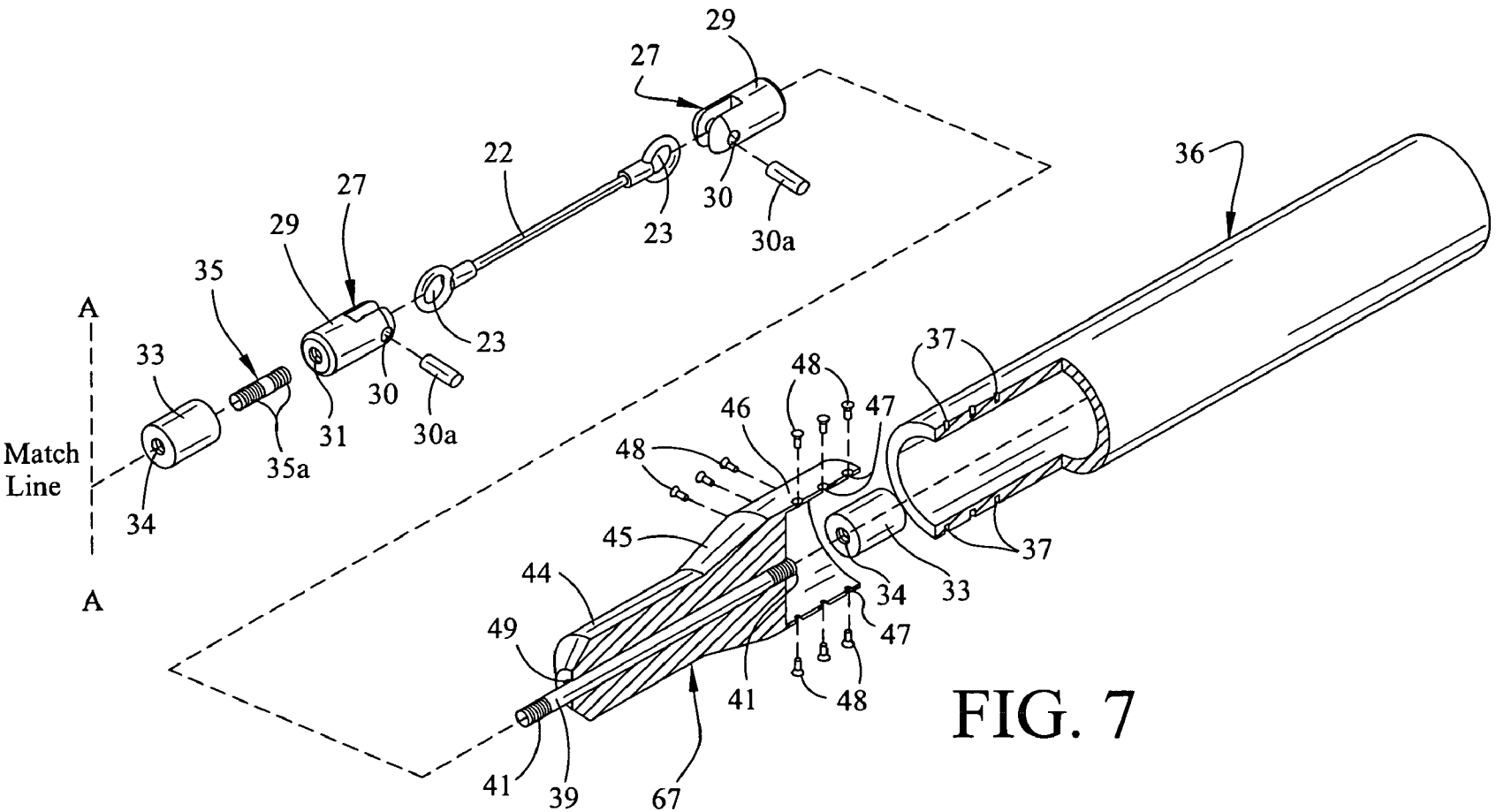

It will be appreciated by those skilled in the art that while the bore hole reaming apparatus 1 is illustrated in FIG. 1 in a complete, "made up" configuration in the entry pit 13, in a typical application the lead bursting head 43 will be initially attached to the projecting end of the pull rod 40 at the lead pull rod adaptor 39 using the clevis coupling 27, as hereinafter further described. The lead bursting head 43 will then be pulled into the entry pit bore 14 by operation of the pulling apparatus 2 illustrated in FIG. 2, which is operated according to the procedure outlined in my U.S. Pat. No. 7,025,536. The middle bursting head 63 is then attached to the lead pull rod adaptor 39 projecting from the interior of the lead bursting head 43, typically using a second pull rod adaptor 39 and the middle bursting head 63 is also incrementally pulled into the entry pit bore 14 by the pulling apparatus 2. The third bursting head 65 is then attached to that portion of the second pull rod adaptor projecting from the middle bursting head 63, using a third pull rod adaptor 39 and the first mandrel 52 is attached to the third bursting head 65 using an additional pull rod adaptor 39, as further hereinafter described. If needed, a second mandrel 61 is then attached to the first mandrel 62 by application of another pull rod adaptor 39, to make up the mandrel assembly 51, as further illustrated in FIG. 1. The combination third bursting head 65 and mandrel assembly 51, which includes the first mandrel 52 and the second mandrel 61, is then pulled through the entry pit bore 14 by operation of the pulling apparatus 2. One end of the cable 22 is then attached to the clevis coupling 27 extending from the open end of the second mandrel 61 and connected to a pull rod adaptor 39, and the opposite end of the cable 22 is secured to another clevis coupling 27 which is connected to a last pull rod adaptor 39, extending through a rear bursting head 67 (FIG. 7). The rear bursting head 67 is then secured to the string of pipe 36, typically using the pipe mount bolts 48 and the pulling apparatus 2 is operated to pull the rear bursting head 67 and the pipe 36 sequentially through the entry bore 14 until the pipe 36 is located in the enlarged bore 19 without excessive room for floating, as illustrated in FIGS. 3-5 of the drawings.

Referring again to FIGS. 1 and 3-7 of the drawings, it will be appreciated by those skilled in the art that the bore hole reaming apparatus 1 of this invention can be characterized in one embodiment by a selected number of the lead bursting head 43, middle bursting head 63, third bursting head 65 and rear bursting head 67 and including or omitting a mandrel or mandrel assembly 51, depending upon the characteristics of the original linear bore 18 in the terrain 7 connecting the entry pit bore 14 and the exit pit bore 17. For example, under circumstances where the undersized linear bore 18 is fairly smooth and regular in its path between the entry pit bore 14 and the exit pit bore 17, it may not be necessary to use a mandrel or an assembly 51 and one or more of the bursting heads may be attached to the pull rod 40 and corresponding pull rod adaptors 39, respectively, to simply enlarge and clean the linear bore 18, define the enlarged bore 19 and guide the pipe 36 through the enlarged bore 19. However, under circumstances where the linear bore 18 is irregular or includes particulate matter that has encroached into the linear bore 18 after the linear bore 18 was drilled, then one or more of the first mandrel 52 and second mandrel 61 can be placed in the tandem bore hole reaming apparatus and used to straighten out the irregularities, smooth and clean the bore hole and help enlarge the linear bore 18 to correspond to the enhanced enlarged bore 19 illustrated in FIGS. 3-5. This action facilitates pulling the string of pipe 36 through the enlarged bore 19 with a minimum of friction, causing little or no damage to the pipe 36. Since the pipe 36 is typically welded HDPE pipe of selected wall thickness, it is highly advantageous to create an enlarged bore 19 which is relatively straight, clean and smooth, to allow smooth movement of the pipe 36 therethrough with minimum friction, and yet snugly encase the pipe to prevent floating or misalignment due to an excessively large bore. Accordingly, the mandrel assembly 51, including the first mandrel 52 and second mandrel 61, serves to straighten out the bore irregularities and smooth and enlarge the linear bore 18 to correspond to the enlarged bore 19 and prepare the way for the pipe 36. Furthermore, it will be appreciated from a consideration of FIG. 1, that the bore hole reaming apparatus 1 can articulate through the linear bore 18 and the enlarged bore 19 at the respective lead bursting head 43, middle bursting head 63, third bursting head 65, mandrel assembly 51 and the rear bursting head 67, since these elements are connected to each other, typically using clevis-type connectors on the pull rod adaptors 39 and using the flexible cable 22, as hereinafter detailed.

Referring now to FIGS. 1, 3-5, 6 and 7 of the drawings, in a preferred embodiment of the invention the pull rod 40 is typically connected to the first length of end-threaded pull rod adaptor 39 having adaptor threads 41 at each end, by a clevis coupling 27, which is typically characterized by a male coupling 28 and a female coupling 29, joined at aligned and registering pin openings 30 by means of a pin 30*a* (FIGS. 3 and 6). The male coupling 28 and female coupling 29 each have internal clevis coupling threads 31 for threading on the adaptor threads 41 of the lead pull rod adaptor 39 and the pull rod threads 40*a* on the pull rod 40, respectively. In similar manner, the opposite end of the first length of pull rod adaptor 39 extends through a bursting head bore 49 provided in the lead bursting head 43 and the rear adaptor threads 41 receive an internally-threaded rod coupling 33 for securing the first length of pull rod adaptor 39 in place in the lead bursting head 43 (FIGS. 3 and 6). One end of a second pull rod adaptor 39, fitted with additional pull rod threads 41 at each end, is attached to the rod coupling 33 and extends through a corresponding bursting head bore 49 in a middle bursting head 63, as further illustrated in FIGS. 3 and 6. The opposite end of the second length of pull rod adaptor 39 is also provided with adaptor threads 41 for receiving a second rod coupling 33, having internal rod coupling threads 34 and the second rod coupling 33, also having rod coupling threads 34, also receives one end of a third length of pull rod adaptor 39, fitted with adaptor threads 41 and extending through the bursting head bore 49 of a third bursting head 65, to threaded attachment to another rod coupling 33. A fourth pull rod adaptor 39, also having adaptor threads 41 at each end, extends through the first mandrel 52 of a mandrel assembly 51 (FIG. 6) and is connected to the third pull rod adaptor 39 by a rod coupling 33, having rod coupling threads 34. A rod coupling 33 is also secured to the opposite, or rear end of the fourth pull rod adaptor 39 at the corresponding adaptor threads 41 and rod coupling threads 34. One threaded end of a fifth pull rod adaptor 39 is threadably inserted in this rod coupling 33 and extends rearwardly through the second mandrel 61 of the mandrel assembly 51, where it threads into yet another rod coupling 33, fitted with a stud 35, having stud threads 35*a* on both ends thereof (FIG. 7). The stud 35 receives the female coupling 29 element of a clevis coupling 27 at the clevis coupling threads 31 and a cable loop 23 of the cable 22 is connected to the female coupling 29 of the clevis coupling 27, using a pin 30*a* extending through a pin opening 30, as further illustrated in FIG. 7. The opposite or rear cable loop 23 provided on the cable 22 is secured to yet another female coupling 29 element of a clevis coupling 27 by a second pin 30*a*, extending through a pin opening 30, as further illustrated in FIG. 7. This last clevis coupling 27 is, in turn, threadably attached to one end of the sixth and last end-threaded pull rod adaptor 39, extending through the bursting head bore 49 of the rear bursting head 67. The adaptor threads 41 provided on the opposite end of the last pull rod adaptor 39 are connected to yet another rod coupling 33 at the rod coupling threads 34, to complete the attachment of the tandem-mounted elements of the bore hole reaming apparatus 1 to the pull rod 40 in articulating configuration. The welded length or string of pipe 36 is then attached to the pipe mount cylinder 46 of the rear bursting head 67, typically by pipe mount bolts or screws 48, extending through mount screw or bolt openings 47 provided in the pipe mount cylinder 46 and seated in corresponding pipe mount openings 37 provided in the pipe 36, as further illustrated in FIG. 7.

Referring again to FIGS. 1, 6 and 7 of the drawings, each of the lead bursting head 43, middle bursting head 63, third bursting head 65 and the rear bursting head 67 are typically characterized by a cylindrical bursting head housing 44, having a housing expander 45 that extends from the bursting head housing 44 to the pipe mount cylinder 46. Multiple, radially-oriented and aligned mount screw or bolt openings 47 are typically provided in each of the pipe mount cylinders 46 to facilitate connecting these elements of the apparatus to a length of pipe 36, as deemed necessary. The mount screw or bolt openings 47 also serve to receive the pipe mount bolts 48 for securing a mandrel assembly 51, including the first mandrel 52, to the pipe mount cylinder 46 of the third bursting head 65 as illustrated in FIG. 1.

Referring again to the mandrel assembly 51 illustrated in FIGS. 1, 6 and 7 of the drawings and particularly to FIG. 6, each of the first mandrel 52 and the second mandrel 61 is typically characterized by a mandrel collar 53 and a recess 58 at opposite ends thereof. For example, as illustrated in FIG. 6, the mandrel collar 53 of the second mandrel 61 is designed to engage and fit inside the recess 58 provided in the opposite end of the first mandrel 52, to join the first mandrel 52 and the second mandrel 61 in the mandrel assembly 51. When the mandrels are so engaged, collar mount bolts 55 are extended through recess openings 59 provided in the recess 58 of the first mandrel 52 and into aligned collar openings 54 provided in the corresponding mandrel collar 53 in the second mandrel 51, to removably secure the first mandrel 52 to the second mandrel 61 as the mandrel assembly 51 illustrated in FIG. 1. As further illustrated in FIG. 6, a mandrel wall 56 is provided in the rear ends of the first mandrel 52 and the second mandrel 61 to define the recess 58 in each case and to seat the corresponding rod couplings 33, attached to the pull rod adaptors 39 extending through the first mandrel 52 and the second mandrel 61. A wall opening 57 is provided in the center of each of the mandrel walls 56 to receive the two pull rod adaptors 39 that extend through the first mandrel 52 and the second mandrel 61, respectively.

It will be appreciated by those skilled in the art that the embodiments of the bore hole reaming apparatus of this invention provide a versatile and effective technique for pulling a length of pipe, and plastic pipe in particular, through a pre-bored, undersized opening or hole in a terrain for selected distances using a pulling apparatus of selected design. The reaming apparatus is versatile, in that selected units of the bursting head and mandrel units can be utilized and placed in tandem in articulating fashion in the manner described above, to enlarge, smooth and clear the undersized pre-drill bore hole and facilitate passage and seating of the pipe string with minimum friction applied to the pipe during the pulling operation. Moreover, the operation can be effected without the necessity of digging a trench to lay the pipe, with only the requirement of an entry pit and exit pit for housing the reaming apparatus and the pulling device, respectively.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A reaming apparatus for enlarging and cleaning a bore hole having an entrance end and an exit end, said reaming apparatus comprising a first cleaning head provided at the entrance end of the bore hole; a second cleaning head attached to said first cleaning head for receiving a string of pipe; at least one mandrel interposed between said first cleaning head and said second cleaning head for enlarging and straightening the bore hole; a rod having one end connected to said first cleaning head and the opposite end of said rod extending through the bore hole to the exit end of the bore hole; and a pulling apparatus connected to said opposite end of said rod for pulling said first cleaning head, said second cleaning head, said mandrel and the string of pipe from the entrance end of the bore hole through the bore hole to the exit end of the bore hole responsive to operation of said pulling apparatus.

2. The reaming apparatus of claim 1 wherein said second cleaning head comprises a pipe bursting head adapted to removably receive the string of pipe.

3. The reaming apparatus of claim 1 wherein said first cleaning head and said second cleaning head each comprise a pipe bursting head.

4. A reaming apparatus for enlarging, cleaning and smoothing a bore hole having an exit end and an entrance end, said reaming apparatus comprising a first cleaning head provided at the entrance end of the bore hole; a rod having one end connected to said first cleaning head and the opposite end of said rod extending through the bore hole to the exit end of the bore hole; a second cleaning head connected to said first cleaning head in spaced-apart, tandem relationship with respect to said first cleaning head; at least one mandrel carried by said second cleaning head for smoothing the bore hole; a third cleaning head connected to said mandrel in spaced-apart, tandem relationship with respect to said mandrel for receiving a string of pipe; and a pulling apparatus connected to said opposite end of said rod at the exit end of the bore hole for pulling said first cleaning head, said second cleaning head, said mandrel, said third cleaning head and the string of pipe from the entrance end of the bore hole through the bore hole to the exit end of the bore hole responsive to operation of said pulling apparatus.

5. The reaming apparatus of claim 4 comprising a flexible cable connected to said mandrel and said third cleaning head for securing said third cleaning head to said mandrel in articulating relationship.

6. The reaming apparatus of claim 4 comprising an auxiliary cleaning head interposed between said first cleaning head and said second cleaning head in spaced-apart relationship, respectively, for enhancing said enlarging, cleaning and smoothing of the bore hole.

7. The reaming apparatus of claim 4 wherein said first cleaning head, said second cleaning head and said third cleaning head comprise first, second and third pipe bursting heads, respectively.

8. The reaming apparatus of claim 7 comprising a flexible cable connected to said mandrel and said third bursting head for securing said third bursting head to said mandrel in articulating relationship.

9. The reaming apparatus of claim 8 comprising an auxiliary pipe bursting head connected to said first pipe bursting head and said second pipe bursting head in spaced-apart relationship, respectively, for enhancing said enlarging, cleaning and smoothing of the bore hole.

10. The reaming apparatus of claim 4 wherein said at least one mandrel comprises a pair of connected mandrels and wherein said third cleaning head is connected to one of said mandrels in spaced-apart relationship with respect to each other.

11. The reaming apparatus of claim 10 wherein said first cleaning head, said second cleaning head and said third cleaning head comprise first, second and third pipe bursting heads, respectively.

12. The reaming apparatus of claim 11 comprising a flexible cable connected to said one of said mandrels and said third bursting head for securing said third bursting head to said one of said mandrels in articulating relationship.

13. The reaming apparatus of claim 12 comprising an auxiliary pipe bursting head connected to said first pipe bursting head and said second pipe bursting head for enhancing said enlarging, cleaning and smoothing of the bore hole.

14. In a trenchless disposition of a pipe string in a bore hole having an entrance end and an exit end using a pulling apparatus located at the exit end of the bore hole and a pull rod extending through the bore hole, with one end of the pull rod connected to the pulling apparatus at the exit end of the bore hole and the opposite end of the pull rod extending from the entrance end of the bore hole, wherein the improvement comprises a reaming device characterized by a plurality of pipe bursting heads arranged in a spaced-apart, tandem string connected to the pull rod, wherein the last one of said pipe bursting heads in said tandem string is adapted to receive the string of pipe and comprising at least one mandrel connected to a selected one of said pipe bursting heads for enlarging and straightening the bore hole.

* * * * *